United States Patent [19]

Scheffler et al.

[11] 4,086,462

[45] Apr. 25, 1978

[54] INDUCTION HEATING SYSTEM FOR THE CONTINUOUS FLOW HEATING OF WORKPIECES

[75] Inventors: Friedrich Scheffler; Ernst Stangl, both of Remscheid, Germany

[73] Assignee: AEG-Elotherm G.m.b.H., Remscheid-Hasten, Germany

[21] Appl. No.: 716,354

[22] Filed: Aug. 20, 1976

[30] Foreign Application Priority Data

Sep. 3, 1975 Germany ..... 2539083

[51] Int. Cl.[2] ..... H05B 5/06

[52] U.S. Cl. ..... 219/10.71; 219/10.75; 219/10.79

[58] Field of Search ..... 219/10.69, 10.71, 10.73, 219/10.41, 10.79, 10.67, 10.75, 10.61; 336/171, 181; 361/150, 212

[56] References Cited

U.S. PATENT DOCUMENTS 2,858,405 10/1958 Kimbrough et al. ..... 219/10.67

*Primary Examiner*—Bruce A. Reynolds

*Attorney, Agent, or Firm*—Cushman, Darby & Cushman

[57] ABSTRACT

A system for induction heating of workpieces which are transported touching or in close proximity through a succession of inductor coils along the workpiece axes. A grounded feeder supplies workpieces to the transporting structure and a grounded further processing machine receives the workpieces after heating. To eliminate sparking and corrosion problems, the AC currents fed to the coils are adjusted, for example by feeding currents in phase opposition to different coils, so that the potential along the direction of the workpieces from the first to last coil is substantially zero.

4 Claims, 1 Drawing Figure

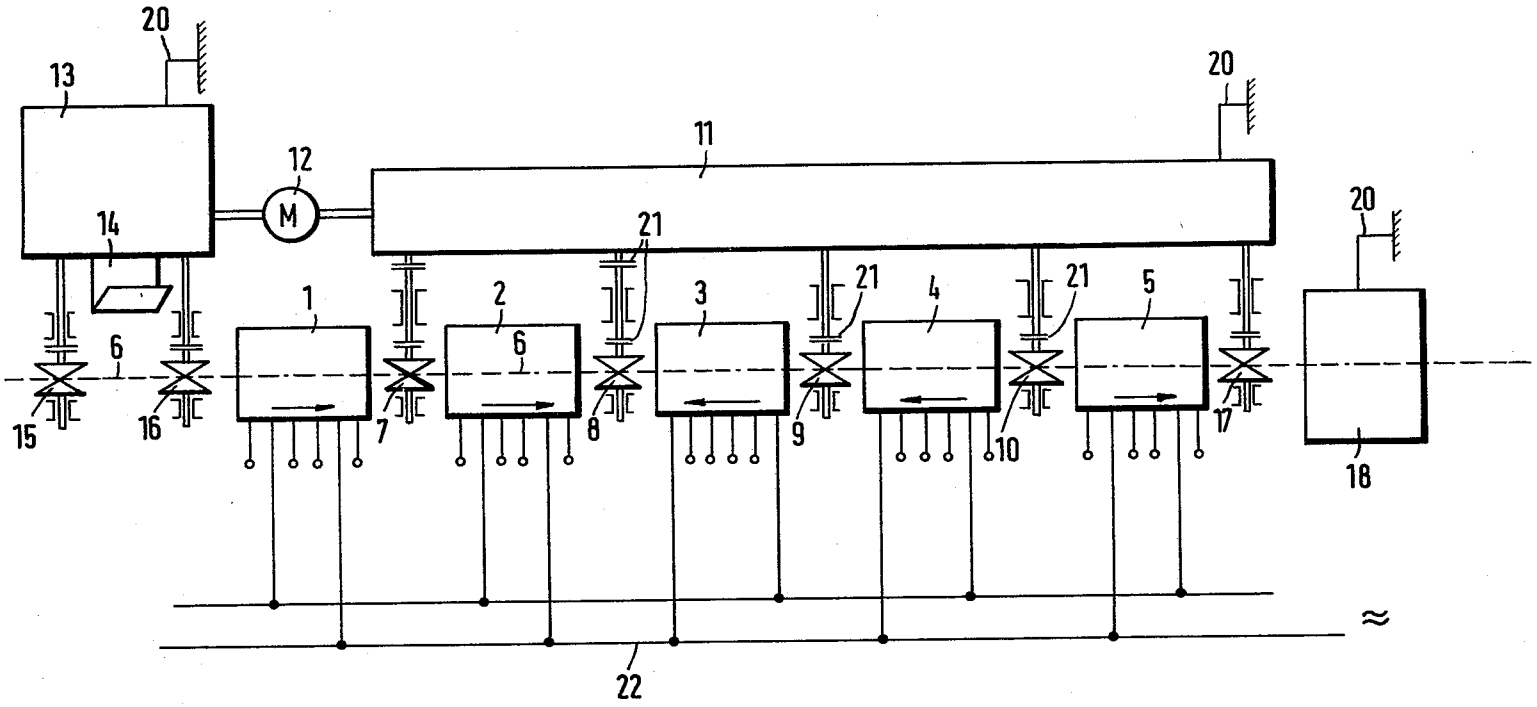
20
18
20
17
5
21
10
4
21
9
11
3
21
8
2
6
7
12
M
1
20
16
14
6
13
15
22

INDUCTION HEATING SYSTEM FOR THE CONTINUOUS FLOW HEATING OF WORKPIECES

This invention relates to an induction heating system for the continuous flow heating of workpieces provided with a longitudinal axis, especially of clubs, rods, pipes, etc., having means for transporting the workpieces in the direction of their longitudinal axis along a defined path which is encompassed successively by several induction coils which are fed from one or several sources of current with AC currents. The structure for feeding the workpieces to the induction coils and the structure for removing the workpieces are disposed in the path of said workpieces.

For heating elongated workpieces, which are to be subjected to a hot-forming process, it is known to feed the workpieces individually and in succession to several induction furnaces embracing the workpieces along their longitudinal direction, which furnaces successively and inductively heat each workpiece during its transportation through the coils to the temperature which is required for the hot-forming. As a rule, the workpieces are fed to the input of the transportation path so that the workpieces are pushed through the totality of the induction furnaces in the form of a column or train of workpieces.

At the same time, for reasons of electric safety, the apparatus which serves for the feeding in of the workpieces to the path of transportation and the apparatus which serves for their removal from the path of transportation is electrically grounded, so that in the case of electric faults, e.g., insulation failures, situations endangering the operating crew cannot occur.

It has been known that sparks often occur between the workpieces touching each other on the path of transportation when the installation is in operation, which sparks are connected with a flow of current between the mutually touching workpieces. Sparking occurs also upon contact of the workpieces which are moved in the form of a column along the path of transportation with a machine which is thus series connected to the path of transportation and which is grounded. In the same manner, one can observe the formation of sparks between workpieces already located on the path of transportation and workpieces placed into the path of transportation, at the inlet of the heating system in front of the induction furnaces. The same phenomenon also occurs during refilling of the magazine disposed at the beginning of the path of transportation, between the newly inserted workpieces and the workpieces already located in the magazine.

A study of this phenomenon has shown that alternating currents can flow across the workpieces — in the case of a relatively low voltage — which can lead in the vicinity of grounding conductors to a noticeable inductive heating of metallic construction elements disposed in the vicinity of such conductors.

Little attention has been paid hitherto to these phenomena, since it was assumed that they were harmless side effects. In the case of starting up fairly large heating installations, where a fairly large number of induction coils, e.g., 5 to 15 coils, are being used, after a relatively short time of operation, corrosion occurs on the individual construction elements of the apparatuses cooperating with the heating system, which corrosion can be traced back to electrical erosions of the participating materials.

Since the pertinent AC currents can be traced back to the potentials induced inductively in the workpieces by means of induction coils, the differences of which potentials — measured along the longitudinal axis of the workpieces — is not zero, it has been known in order to avoid electric erosion of transporting rolls, which serve for the transportation of the bar-shaped material through the furnace installation, to arrange the transporting rolls electrically insulated, as a result of which the flow of the current across these rolls is interrupted and thus the destruction of pertinent materials is prevented.

The attempt has also been made to take corresponding measures to insulate such paths of the installation which feed in the bar-shaped material to the transportation path and remove the workpieces from the path of transportation. These measures, however, have turned out to be difficult as far as construction is concerned in each individual case. This is also true especially for the forging machines, etc., which are series connected to the heating systems and which serve for the hot-forming of the elongated workpieces.

Therefore, the invention deals with the task of providing an induction heating system of the type described in more detail above in such a way that corrosion resulting from alternating currents which flow in an undesirable manner between the workpieces and the grounded parts of the system will be avoided.

According to this invention, this problem is solved wherein the individual induction coils are always fed with alternating currents in such a way, that the sum of the differences of the electric potential, measured in the longitudinal direction of its strand or train, induced by the coils' alternating fields in a strand of workpieces resting between the beginning of the first induction coil and the end of the last induction coil without allowing a gap on the path of continuous transportation is at least substantially zero.

At the same time, all induction coils are fed with alternating currents of the same frequency, whereby at least one of the coils is fed in phase opposition in relation to the remaining coils in such a way, that the proper longitudinal voltage which is induced by this coil in the strand of workpieces — measured in longitudinal direction of the strand — balances out or compensates for the sum of the corresponding voltages which are induced in the strand by the other coils.

The arrangement can also be made in such a way, that the induced longitudinal voltages which are to be compensated, are balanced out through phase opposition feeding of individual coils and by adjustment of the number of windings of such coils or by adjustment of the currents which are fed to the individual coils.

In order to prevent electro-corrosion of individual workpieces which are transported touching each other and under certain circumstances with alternating distances along the path of transportation, beside the total longitudinal voltage, which can be measured between the inlet of the first induction coil and the outlet of the last induction coil of the system, partial amounts of such voltages which are induced in one continuous strand by parts of the total system can also be compensated per se, so that not only the sum of the total differences of potential is equal to or approximately equal to zero, but that partial voltages, which are produced in parts of the induction heating system along the path of transportation, are compensated substantially to zero.

In the described embodiment, the column of the workpieces which penetrates the induction coils is completely eliminated, the length of which corresponds essentially to the length of the arrangement of the coils, as a significant AC current generator, so that the proper erosion currents which are closed via pertinent grounded lines, remain correspondingly small. As a result of this measure, the useful life of the pertinent construction elements, which can be destroyed within a few months, is considerably prolonged.

The attached drawing serves for the explanation of the process of the invention and at the same time for the explanation of a heating system which serves for carrying out this process.

In the FIGURE, the numbers 1, 2, 3, 4 and 5 designate cylindrical induction coils of the usual construction, which have been disposed one behind the other at a slight distance from each other along the path 6 of workpiece transportation (drawn in a broken line) and which encompasses the path of transportation.

The numerals 7, 8, 9 and 10 designate conveying rolls disposed between the coils, which are driven by way of a gear system 11 by means of a motor 12 for transporting bar-shaped material to be heated by the induction coils 1, 2, 3, 4 and 5.

Feeding arrangement 13 houses a supply of the elongated workpieces to be heated electrically in a magazine. By way of transportation means 14 (not shown in detail) the path of transportation 6 is fed by the arrangement 13, driven by the motor 12, by placing the bar-shaped workpieces onto transporting rolls 15 and 16.

The number 17 designates an additional transporting roll disposed at the outlet of the series of coils, which carries each workpiece to a processing machine 18. Processing machine 18 can be a forging machine to which a cutting arrangement (not shown) has been assigned, which cuts the elongated workpieces, which appear at the outlet of the coil 5 under control of a pulse generator, always by a partial length and then feeds this part of the workpiece to the forging deformation.

The devices 11, 13 and 18 are grounded by way of assigned ground conductors 20. Transporting rolls 7, 8, 9, 10 and 17 are always electrically insulated from the gear system 11 in their driving shaft by insulation 21 and are also electrically insulated by other means (not shown). Medium frequency lines 22 connect the coils to an alternating current generator, e.g., an inverter with its DC input supplied by a rectifier, which lines serve for feeding coils 1, 2, 3, 4 and 5.

For this purpose, the coils have been provided with taps, which have not been given any reference numbers, which will permit the connection of a selectable number of windings of the individual coils to the network 22. The arrangement is made in such a way that, e.g., the induction coils 1, 2 and 5 are fed with in-phase currents from the network 22, and coils 3 and 4 are fed in phase opposition to the coils 1, 2 and 5 from lines 22, whereby the number of windings of the individual coils is mutually adjusted in such a way that the sum of the differences of potential which are developed by the individual coils in the rod-shaped material, which is transported along the path 6 of transportation and, measured in a longitudinal respectively transporting direction of the workpieces, is equal to or approximately equal to zero. The pertinent adjustment is accomplished during the first starting up of the induction heating system. The adjustment can also be accomplished by adjusting the amplitude of the pertinent feeder AC current.

Alternatively, it can be effective to combine the individual induction coils of the heating system into groups, which always have at least two induction coils, and to make the arrangement such that the above mentioned longitudinal voltage is compensated within each of the groups. Under such conditions and insofar as the workpieces are shorter than the length of the path of transportation, which corresponds to the furnace installation, sparking between workpieces abutting each other in the area of the extent of the furnace is avoided.

Many changes and modifications in the above-described embodiment can, of course, be carried out without departing from the scope of the invention. The individual induction coils of the installation need not be spatially separated from one another. Rather, it is also possible to divide individual induction coils and to separate them galvanically one from the other so that they can be compensated by the longitudinal voltages induced in the workpieces. Accordingly, the scope of the invention is intended to be limited only by the scope of the appended claims.

What is claimed is:

1. An induction heating system for heating in continuous passage of workpieces provided with a longitudinal axis, comprising:

means for transporting said workpieces successively along a path in the direction of their longitudinal axis;

a plurality of induction coils successively encompassing the workpieces along said path which can be supplied with alternating currents from at least one source of current;

means preceding said induction coils in the path of said workpieces for feeding the workpieces to said path; and means following said coils for removing the workpieces from said path, and means for supplying the individual induction coils with AC currents so that the differences of the electric potential, measured in the longitudinal direction of the strand and induced by their alternating fields in a plurality of workpieces resting without gaps on the continuous path of transportation between the beginning of the first induction coil and the end of the last induction coil is substantially zero.

2. An induction heating system as in claim 1, including an AC current grid connected to each of said coils for supplying current thereto, and means for supplying at least one induction coil in phase opposition to another induction coil.

3. Induction heating system as in claim 2, wherein several induction coils are disposed directly in succession along the path of transportation and as a group have induction coils fed in phase opposition so that the sum of the differences of electric potential induced in one strand of workpieces by this group along the path of transportation and measured along the longitudinal axis of said strand is substantially zero.

4. A system as in claim 3, further including a source of potential connected to said coils.

* * * * *